US008366463B2

(12) United States Patent
Zhang et al.

(10) Patent No.: US 8,366,463 B2
(45) Date of Patent: Feb. 5, 2013

(54) SAFETY STRUCTURE FOR ELECTRIC RECEPTACLES AND POWER STRIPS

(75) Inventors: Yulin Zhang, Zhejiang (CN); Bin Liu, Zhejiang (CN); Jianning Jiang, Zhejiang (CN)

(73) Assignee: Heng Chen, Shanghai (CN)

( * ) Notice: Subject to any disclaimer, the term of this patent is extended or adjusted under 35 U.S.C. 154(b) by 142 days.

(21) Appl. No.: 12/949,251

(22) Filed: Nov. 18, 2010

(65) Prior Publication Data

US 2011/0136358 A1 Jun. 9, 2011

(30) Foreign Application Priority Data

Dec. 7, 2009 (CN) ..... 2009 2 0274703 U

(51) Int. Cl.
*H01R 13/44* (2006.01)

(52) U.S. Cl. ..... 439/135

(58) Field of Classification Search ..... 439/135–145, 439/76.2, 709
See application file for complete search history.

(56) References Cited

U.S. PATENT DOCUMENTS

| | | | | |
|---|---|---|---|---|
| 7,588,447 | B1 * | 9/2009 | Ni | 439/137 |
| 7,883,346 | B2 * | 2/2011 | Huang | 439/140 |
| 7,887,346 | B1 * | 2/2011 | Huang | 439/140 |
| 7,985,085 | B2 * | 7/2011 | Gao | 439/137 |

* cited by examiner

*Primary Examiner* — Jean F Duverne
(74) *Attorney, Agent, or Firm* — The PL Law Group, PLLC

(57) ABSTRACT

A symmetrically movable safety structure disposed inside of an upper lid of a power panel, includes a cover plate disposed with a jack corresponding to the upper lid, a first shielding part and a second shielding part, disposed within the cover plate, where a first bonding position and a second bonding position corresponding to the jack are formed at a contacting place of the above two shielding parts, and a first elastic part and a second elastic part, wherein the first elastic part is disposed between the cover plate and the first shielding part, the second elastic part is disposed between the cover plate and the second shielding part, and the first shielding part and the second shielding part contact with each other under elastic force application directions.

16 Claims, 2 Drawing Sheets

SAFETY STRUCTURE FOR ELECTRIC RECEPTACLES AND POWER STRIPS

CROSS-REFERENCE TO RELATED PATENT APPLICATION

This application claims priority to and the benefit of China Patent Applications No. 200920274703.8, filed Dec. 7, 2009, the content of which is incorporated herein in its entirety by reference.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference were individually incorporated by reference.

FIELD OF THE INVENTION

The present invention relates to a safety component of a power supply connection device, and more particularly to a half-frame symmetrically movable safety structure applied to various electric outlets/receptacles/sockets and power strips to prevent an accidental electric shock.

BACKGROUND OF THE INVENTION

Currently, hidden dangers exist in an overwhelming majority of existing ordinary wall outlets/receptacles and power strips available in the market. For example, due to a strong curiosity, children may try to hold a piece of conductive metal thin stick with a hand and insert it into a left hole or a right hole of an outlet/receptacle. In this case, they would get shocked, which greatly influences a safety performance of such a product.

Therefore, a heretofore unaddressed need exists in the art to address the aforementioned deficiencies and inadequacies.

SUMMARY OF THE INVENTION

A safety structure design of the present invention can totally avoid occurrence of the above case, so as to enhance the security protection function.

The present invention in one aspect is directed to a small sized half-frame symmetrically movable safety structure for overcoming the above defect.

In order to fulfill the purpose, a technical solution of the present invention provides a small sized half-frame symmetrically movable safety structure, which is disposed inside of an upper lid of a power panel and comprises a cover plate, on which a jack corresponding to the upper lid is disposed, a first shielding part and a second shielding part, disposed within the cover plate, in which a first bonding position and a second bonding position corresponding to the jack are formed at a contacting place of the above two shielding parts, and a first elastic part and a second elastic part, in which the first elastic part is disposed between the cover plate and the first shielding part, the second elastic part is disposed between the cover plate and the second shielding part, and the first shielding part and the second shielding part contact with each other under elastic force application directions.

Preferably, two fixing blocks are disposed in opposite position on the same side of the cover plate, and positioning slots are formed within the fixing blocks.

The first shielding part and the second shielding part each have a protruding end, the first elastic part is disposed between the protruding end of the first shielding part and one of the positioning slots, and the second elastic part is disposed between the protruding end of the second shielding part and the other of the positioning slots.

Preferably, internal support ribs are disposed for the cover plate, and the support ribs are disposed at four corners and a center respectively.

Preferably, the first shielding part and the second shielding part are of an F type half-frame structure, and at the center of the cover plate, the internal support rib in the center is located in a space formed by mutual bonding of the above two shielding parts.

The first shielding part and the second shielding part each have a slant block and a concave slot block, the first bonding position is formed between the slant block of the first shielding part and the concave slot block of the second shielding part, and the second bonding position is formed between the slant block of the second shielding part and the concave slot block of the first shielding part.

In one embodiment, the first elastic part and the second elastic part are springs or elastic reeds.

Compared with the prior art, the present invention provides security use of electricity has a compact structure, has reliable actions of implementing safety and normal use, and reduces the cost in practical production.

In another aspect, the invention relates to a safety structure for a power receptacle. The safety structure in one embodiment includes a cover plate having two slits for receiving two prongs of a matching power plug, the cover plate further having two U-shaped slots attached to the inner side thereof, wherein the two slots are arrange diametrically on each side of the two slits such that the opening of one slot faces the opening of the other slot; two shielding members slidably engaged with each other and movably attached to the inner side of the cover plate between the two U-shaped slots; and two spring members, each spring member having a first end and a second end, wherein the first end of each spring member is received by a respective U-shaped slot and the second end of the corresponding spring member is attached to a respective shielding member such that, when no prong is inserted into either of the two slits, the two shielding members are compressed together by the spring force exerted by the two spring members thereby to shield each of the two slits, and when each of the two prongs of a matching power plug is inserted into each of the two slits, respectively, the two shielding members slide apart thereby to allow the two prongs of the plug to be inserted through the two slits into the power receptacle.

In one embodiment, each shielding member has an F-shaped structure with a first ridge at one end thereof and a second ridge positioned substantially parallel to the first ridge, where the second ridge of each shielding member mates with the first ridge of the other shielding member when the two shielding members are compressed together. In one embodiment, the second ridge of each shielding member has a slanted wedge, and the first ridge of each shielding member has a concave slot adapted for receiving the slanted wedge of the second ridge of the other shielding member when the two shielding members are compressed together.

In one embodiment, each spring member is a coil spring or an elastic reed. Each shielding member has a protruding portion at one end thereof for retaining the second end of a corresponding spring member.

In yet another aspect of the present invention, a safety structure for a power receptacle comprises a cover plate having two slits for receiving two prongs of a matching power plug; two shielding members slidably engaged with each other and movably attached to the inner side of the cover plate; and means for compressing the two shielding members together when no prong is inserted into either of the two slits thereby to shield each of the two slits.

In one embodiment, the cover plate has two fixtures attached to the inner side thereof and arranged diametrically on each side of the two slits, and the means for compressing comprises two spring members, wherein one end of each spring member is attached to a respective shielding member and the other end of the corresponding spring member is received by a respective fixture, where each spring member is a coil spring or an elastic reed. Each fixture has a U-shaped slot for receiving one end of a corresponding spring member.

Each shielding member has an F-shaped structure with a first ridge at one end thereof and a second ridge positioned substantially parallel to the first ridge, wherein the second ridge of each shielding member mates with the first ridge of the other shielding member when the two shielding members are compressed together.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The drawings described below are for illustration purpose only. The drawings are not intended to limit the scope of the present teachings in any way.

DETAILED DESCRIPTION OF THE INVENTION

Figure 1:
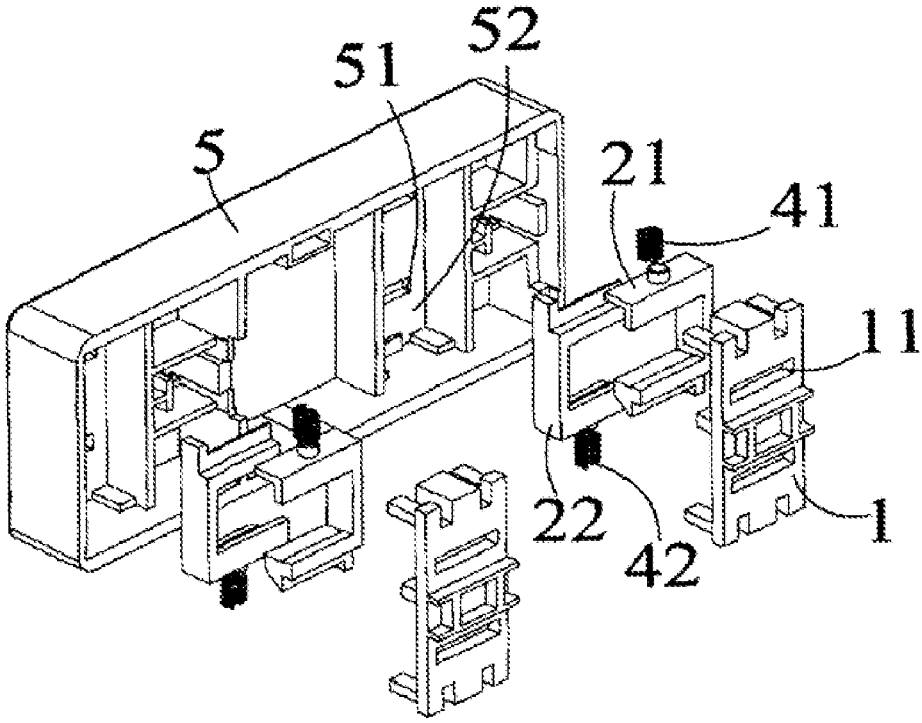
FIG. 1 is a three-dimensional exploded view of a small sized half-frame symmetrically movable safety structure according to the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

As used herein, the term, "wall socket", "power point", "power socket", "electric receptacle", "plug socket", "electrical outlet" or just "socket", is synonym in the specification and refers to mostly or completely a female electrical connector that have slots or holes which accept and deliver current to the prongs of inserted plugs.

As used herein, the term, "power strip", or "power board", is synonym in the specification and refers to a strip of electrical sockets that attaches to the end of a flexible cable and allows multiple devices to be plugged in.

The description will be made as to the embodiments of the present invention in conjunction with the accompanying drawings in FIGS. 1-4. In accordance with the purposes of this invention, as embodied and broadly described herein, this invention, in one aspect, relates to a half-frame symmetrically movable safety structure applied to various electric outlets/receptacles/sockets and power strips to prevent from an accidental electric shock.

FIG. 1 is a three-dimensional exploded view of a small sized half-frame symmetrically movable safety structure according to the present invention. In this embodiment, two groups of the small sized half-frame symmetrically movable safety structures are disposed respectively in a rectangular chute 52 inside of an upper lid 5 of the power panel. The power panel can be a wall outlet or a power strip, and each of the small sized half-frame symmetrically movable safety structures comprises: a cover plate 1, on which a jack 51 corresponding to the upper lid 5 is disposed;

a first shielding part 21 and a second shielding part 22, disposed within the cover plate 1, in which a first bonding position and a second bonding position corresponding to the jack 51 are formed at a contacting place of the two shielding parts; and a first elastic part 41 and a second elastic part 41, in which the first elastic part 41 is disposed between the cover plate 1 and the first shielding part 21, the second elastic part 42 is disposed between the cover plate 1 and the second shielding part 22, the first shielding part 21 and the second shielding part 22 contact with each other under elastic force application directions, and the first elastic part 41 and the second elastic part 42 are springs or elastic reeds.

Figure 2:
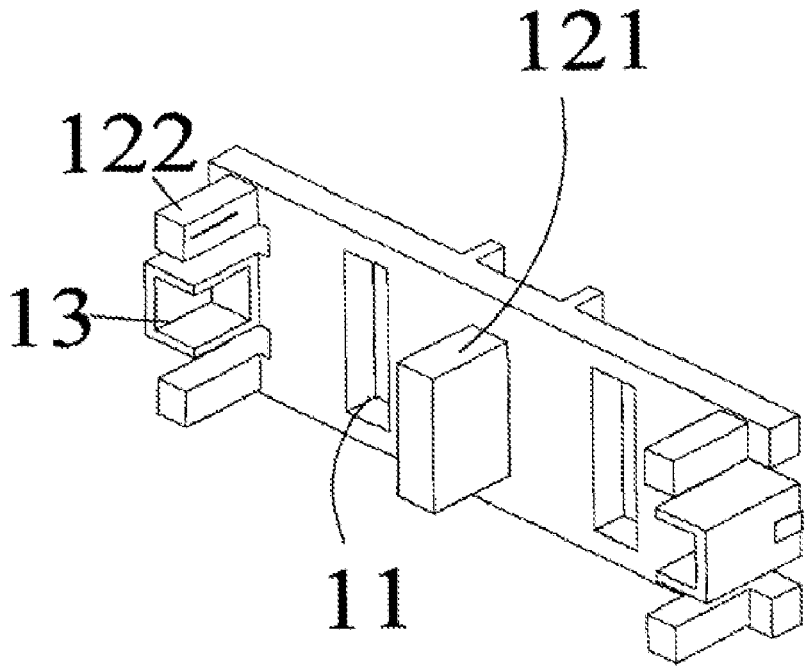
FIG. 2 is a three-dimensional structural view of a cover plate of a small sized half-frame symmetrically movable safety structure according to the present invention.

FIG. 2 is a three-dimensional structural view of a cover plate of a small sized half-frame symmetrically movable safety structure according to the present invention. Two fixing blocks 13 are respectively disposed in two end portions of the cover plate 1 on the same side, a positioning slot is formed within the fixing blocks 13, and the positioning slot is used for accommodating a first elastic part 41 or a second elastic part 42. Internal support ribs are disposed for the cover plate 1, which are five ribs comprising four corner support ribs 122 disposed at four corners and a center support rib 121 disposed at a center respectively, and two jacks 11 are further disposed on a body of the cover plate 1.

Figure 3:
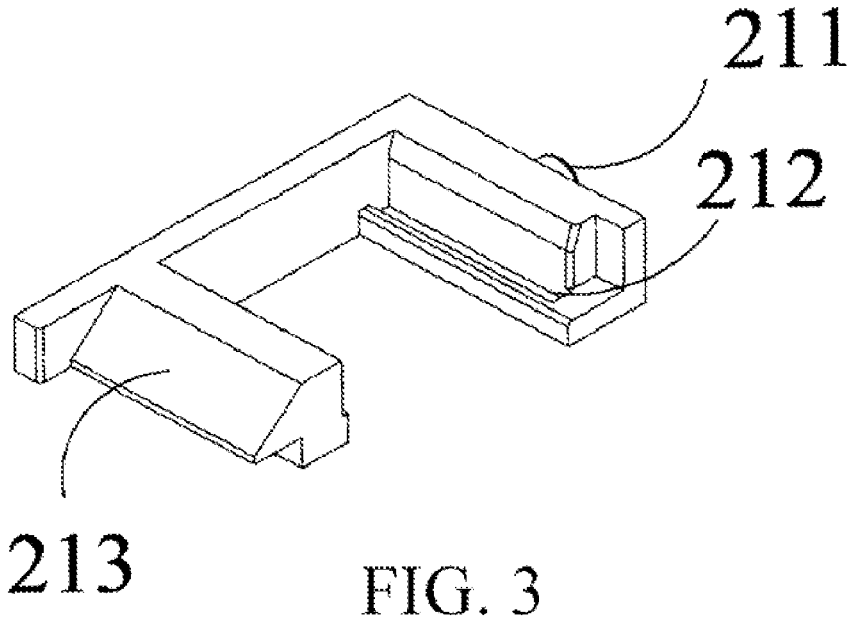
FIG. 3 is a three-dimensional structural view of a first shielding part and a second shielding part of a small sized half-frame symmetrically movable safety structure according to the present invention.

FIG. 3 is a three-dimensional structural view of a first shielding part and a second shielding part of a small sized half-frame symmetrically movable safety structure according to the present invention. The first shielding part 21 and the second shielding part 22 are of an F type half-frame structure, the first shielding part 21 and the second shielding part 22 each have a protruding end 211, and the first shielding part 21 and the second shielding part 22 each have a slant block 213 and a concave slot block 212.

Figure 4:
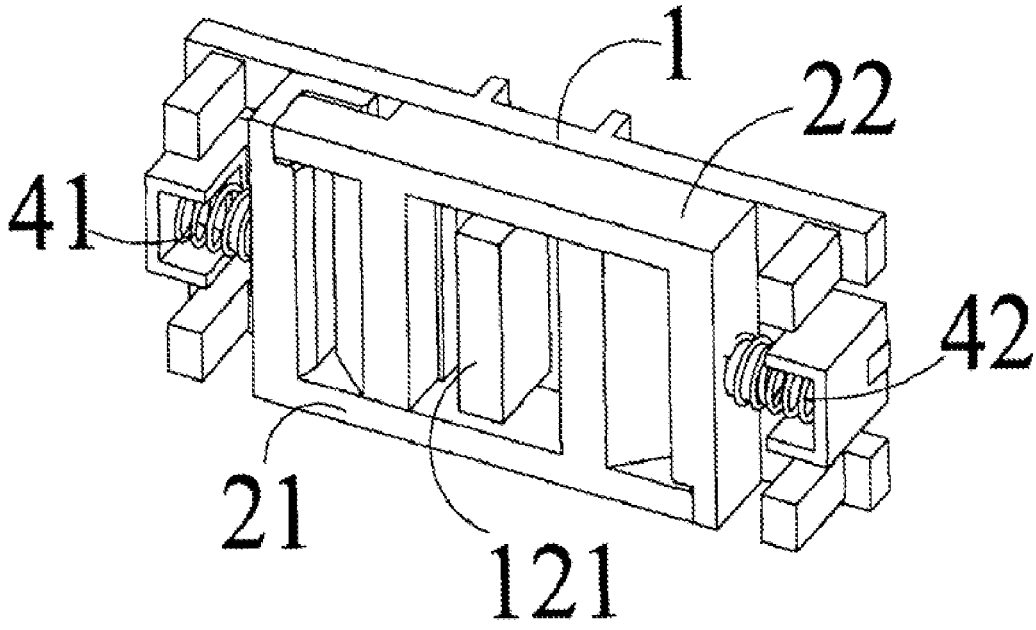
FIG. 4 is a three-dimensional bonding view of a component bonding a small sized half-frame symmetrically movable safety structure and a cover plate according to the present invention.

FIG. 4 is a three-dimensional bonding view of a component bonding a small sized half-frame symmetrically movable safety structure and a cover plate according to the present invention. The first bonding position is formed between the slant block 213 of the first shielding part and the concave slot block of the second shielding part 22, the second bonding position is formed between the slant block of the second shielding part 22 and the concave slot block 212 of the first shielding part, and one staggered hermetical joint is formed between the first shielding part 21 and the second shielding part 22. The internal center support rib 121 at the center of the cover plate 1 is located in a space formed by mutual bonding of the above two shielding parts. The first elastic part 41 is disposed between the protruding end 211 of the first shielding part and one of the positioning slots, and the second elastic part 42 is disposed between the protruding end of the second shielding part and the other of the positioning slots.

Because of application of an external force (such as a power plug), a structure of combining the first shielding part 21 and the second shielding part 22 together can slide in the rectangular chute 52, and the first elastic part 41 and the second elastic part 42 cause the first shielding part 21 and the second shielding part 22 to move in a tracking manner in the chute. After the external force is removed, the first elastic part 41 and the second elastic part 42 can also impel the first shielding part 21 and the second shielding part 22 reposition to shield the jacks, thereby forming the first bonding position and the second bonding position, and preventing foreign matters from entering the outlet jacks.

When a power plug (with two or three pins) is used to insert, the safety structure opens, that is, through movement of the first shielding part 21 and the second shielding part 22, the jacks are exposed, and the pins of the plug can smoothly enter the outlet with the safety structure without hindrance.

If a piece of metal conductor is used to insert into a jack (a left or right hole), because of obstruction of the safety structure, the metal conductor cannot enter the jack. Even if the first shielding part 21 or the second shielding part 22 is poked, because of interaction between the first elastic part 41 and the second elastic part 42, the metal conductor still cannot enter the jack. If the second shielding part 22 (the first shielding part 21) in the safety structure moves, the first shielding part 21 (the second shielding part 22) also moves in a tracking manner, so that no slit is exposed. The first bonding position and the second bonding position formed by the first shielding part 21 and the second shielding part 22 of the safety structure totally shield the jack, so that a metal conductor stick cannot enter the jack, thus realizing security protection.

In another aspect, the invention relates to a safety structure for a power receptacle. The safety structure in one embodiment includes a cover plate having two slits for receiving two prongs of a matching power plug, the cover plate further having two U-shaped slots attached to the inner side thereof, wherein the two slots are arrange diametrically on each side of the two slits such that the opening of one slot faces the opening of the other slot; two shielding members slidably engaged with each other and movably attached to the inner side of the cover plate between the two U-shaped slots; and two spring members, each spring member having a first end and a second end, wherein the first end of each spring member is received by a respective U-shaped slot and the second end of the corresponding spring member is attached to a respective shielding member such that, when no prong is inserted into either of the two slits, the two shielding members are compressed together by the spring force exerted by the two spring members thereby to shield each of the two slits, and when each of the two prongs of a matching power plug is inserted into each of the two slits, respectively, the two shielding members slide apart thereby to allow the two prongs of the plug to be inserted through the two slits into the power receptacle.

In one embodiment, each shielding member has an F-shaped structure with a first ridge at one end thereof and a second ridge positioned substantially parallel to the first ridge, where the second ridge of each shielding member mates with the first ridge of the other shielding member when the two shielding members are compressed together. In one embodiment, the second ridge of each shielding member has a slanted wedge, and the first ridge of each shielding member has a concave slot adapted for receiving the slanted wedge of the second ridge of the other shielding member when the two shielding members are compressed together.

In one embodiment, each spring member is a coil spring or an elastic reed. Each shielding member has a protruding portion at one end thereof for retaining the second end of a corresponding spring member.

In yet another aspect of the present invention, a safety structure for a power receptacle comprises a cover plate having two slits for receiving two prongs of a matching power plug; two shielding members slidably engaged with each other and movably attached to the inner side of the cover plate; and means for compressing the two shielding members together when no prong is inserted into either of the two slits thereby to shield each of the two slits.

In one embodiment, the cover plate has two fixtures attached to the inner side thereof and arranged diametrically on each side of the two slits, and the means for compressing comprises two spring members, wherein one end of each spring member is attached to a respective shielding member and the other end of the corresponding spring member is received by a respective fixture, where each spring member is a coil spring or an elastic reed. Each fixture has a U-shaped slot for receiving one end of a corresponding spring member. Each shielding member has an F-shaped structure with a first ridge at one end thereof and a second ridge positioned substantially parallel to the first ridge, wherein the second ridge of each shielding member mates with the first ridge of the other shielding member when the two shielding members are compressed together.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A symmetrically movable safety structure, disposed inside of an upper lid of a power panel, comprising:

a cover plate, disposed with a jack corresponding to the upper lid;

a first shielding part and a second shielding part, disposed within the cover plate, wherein a first bonding position and a second bonding position corresponding to the jack are formed at a contacting place of the above two shielding parts; and a first elastic part and a second elastic part, wherein the first elastic part is disposed between the cover plate and the first shielding part, the second elastic part is disposed between the cover plate and the second shielding part, and the first shielding part and the second shielding part contact with each other under elastic force application directions.

2. The symmetrically movable safety structure according to claim 1, wherein two fixing blocks are disposed in opposite two end portion on the same side of the cover plate, and positioning slots are formed within the fixing blocks.

3. The symmetrically movable safety structure according to claim 2, wherein the first shielding part and the second shielding part each have a protruding end, the first elastic part is disposed between the protruding end of the first shielding part and one of the positioning slots, and the second elastic part is disposed between the protruding end of the second shielding part and the other of the positioning slots.

4. The symmetrically movable safety structure according to claim 2, wherein internal support ribs are disposed for the cover plate, and the support ribs are disposed at four corners and the center respectively.

5. The symmetrically movable safety structure according to claim 4, wherein the first shielding part and the second shielding part are of an F type half-frame structure, and at the center of the cover plate, the internal support rib in the center is located in a space formed by mutual bonding of the above two shielding parts.

6. The symmetrically movable safety structure according to claim 5, wherein the first shielding part and the second shielding part each have a slant block and a concave slot block, the first bonding position is formed between the slant block of the first shielding part and the concave slot block of the second shielding part, and the second bonding position is formed between the slant block of the second shielding part and the concave slot block of the first shielding part.

7. The symmetrically movable safety structure according to claim 5, wherein the first elastic part and the second elastic part are springs or elastic reeds.

8. A safety structure for a power receptacle comprising:

(a) a cover plate having two slits for receiving two prongs of a matching power plug, the cover plate further having two U-shaped slots attached to the inner side thereof, wherein the two slots are arrange diametrically on each side of the two slits such that the opening of one slot faces the opening of the other slot;

(b) two shielding members slidably engaged with each other and movably attached to the inner side of the cover plate between the two U-shaped slots; and (c) two spring members, each spring member having a first end and a second end, wherein the first end of each spring member is received by a respective U-shaped slot and the second end of the corresponding spring member is attached to a respective shielding member such that, when no prong is inserted into either of the two slits, the two shielding members are compressed together by the spring force exerted by the two spring members thereby to shield each of the two slits, and when each of the two prongs of a matching power plug is inserted into each of the two slits, respectively, the two shielding members slide apart thereby to allow the two prongs of the plug to be inserted through the two slits into the power receptacle.

9. The safety structure of claim 8, wherein each shielding member has an F-shaped structure with a first ridge at one end thereof and a second ridge positioned substantially parallel to the first ridge, wherein the second ridge of each shielding member mates with the first ridge of the other shielding member when the two shielding members are compressed together.

10. The safety structure of claim 9, wherein the second ridge of each shielding member has a slanted wedge, and the first ridge of each shielding member has a concave slot adapted for receiving the slanted wedge of the second ridge of the other shielding member when the two shielding members are compressed together.

11. The safety structure of claim 8, wherein each spring member is a coil spring or an elastic reed.

12. The safety structure of claim 11, wherein each shielding member has a protruding portion at one end thereof for retaining the second end of a corresponding spring member.

13. A safety structure for a power receptacle comprising:

(a) a cover plate having two slits for receiving two prongs of a matching power plug;

(b) two shielding members slidably engaged with each other and movably attached to the inner side of the cover plate; and (c) means for compressing the two shielding members together when no prong is inserted into either of the two slits thereby to shield each of the two slits, wherein the cover plate has two fixtures attached to the inner side thereof and arranged diametrically on each side of the two shielding members, and the means for compressing comprises two spring members, wherein one end of each spring member is attached to a respective shielding member and the other end of the corresponding spring member is received by a respective fixture.

14. The safety structure of claim 13, wherein each spring member is a coil spring or an elastic reed.

15. The safety structure of claim 14, wherein each fixture has a U-shaped slot for receiving one end of a corresponding spring member.

16. The safety structure of claim 13, wherein each shielding member has an F-shaped structure with a first ridge at one end thereof and a second ridge positioned substantially parallel to the first ridge, and wherein the second ridge of each shielding member mates with the first ridge of the other shielding member when the two shielding members are compressed together.

* * * * *